US008118688B2

(12) United States Patent
Nakamura

(10) Patent No.: US 8,118,688 B2
(45) Date of Patent: Feb. 21, 2012

(54) GOLF CLUB HEAD AND METHOD FOR PRODUCING THE SAME

(75) Inventor: Takashi Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 267 days.

(21) Appl. No.: 12/399,708

(22) Filed: Mar. 6, 2009

(65) Prior Publication Data

US 2009/0305812 A1 Dec. 10, 2009

(30) Foreign Application Priority Data

Jun. 5, 2008 (JP) ..... 2008-148355
Jun. 30, 2008 (JP) ..... 2008-170904

(51) Int. Cl.
*A63B 53/04* (2006.01)

(52) U.S. Cl. ..... 473/331; 473/330

(58) Field of Classification Search ..... 473/330, 473/331

See application file for complete search history.

(56) References Cited

U.S. PATENT DOCUMENTS

2006/0003851 A1* 1/2006 Chappell ..... 473/330
2006/0154739 A1* 7/2006 Mann et al. ..... 473/330
2007/0049418 A1* 3/2007 Lin et al. ..... 473/349

FOREIGN PATENT DOCUMENTS

JP 2001-321469 A 11/2001
JP 2007-301017 A 11/2007

* cited by examiner

*Primary Examiner* — Gene Kim
*Assistant Examiner* — Michael Dennis
(74) *Attorney, Agent, or Firm* — Birch, Stewart, Kolasch & Birch, LLP

(57) ABSTRACT

A golf club head 1 having an improved dischargeability of foreign matters such as water and mud caught in face line grooves and a sufficient frictional force with a golf ball generated when hitting the ball, the club head 1 comprising a ball hitting face 2 including a hitting surface 7 and at least one face line groove 8 formed in the hitting surface 7, wherein the hitting surface 7 includes a rough surface portion 7*a* having an arithmetic mean roughness Raf of 0.20 to 0.55 μm, and the surface of the face line groove 8 has an arithmetic mean roughness Ra1 smaller than the arithmetic mean surface roughness Raf of the rough surface portion 7*a*, and a method for producing the club head 1.

5 Claims, 8 Drawing Sheets

GOLF CLUB HEAD AND METHOD FOR PRODUCING THE SAME

BACKGROUND OF THE INVENTION

The present invention relates to a golf club head having face line grooves in the surface of a club face for hitting a golf ball, and more particularly to a golf club head having an improved dischargeability of foreign matters from the face lines without impairing the frictional force with a ball. The present invention also relates to a method for producing such a golf club head having an improved dischargeability of foreign matters from the face lines.

A plurality of narrow grooves extending in a toe-heel direction, i.e., face lines, are formed at intervals in the surface of a ball-hitting face of a golf club head in order to enhance the frictional force with a golf ball. These face lines can enhance the frictional force between the face and a ball by the edges thereof, thus imparting a sufficient back spin to the ball.

On the other hand, foreign matters such as water, mud, grass, a cover material of golf ball and so on may be caught in the face lines during playing. If a golf ball is hit by a golf club head in such a state that foreign matters are caught in the face lines, the frictional force between the face and the ball is decreased, so the amount of back spin is decreased and the flight distance gets unstable. In particular, in case of iron-type golf clubs for which stable flight distance is important, especially a short iron used for short approaches to the green, unstable flight distance is a serious problem. A golf club head capable of effectively removing foreign matters caught in the face lines is proposed for instance in JP 2007-301017 A.

It is known to impart a rough surface to the face of golf club heads by impingement of metal grains onto the surface of the face, as disclosed for example in JP 2001-321469 A.

It is an object of the present invention to provide a golf club head capable of easily discharging foreign matters caught in face line grooves while sufficiently securing a frictional force generating at the time of hitting a golf ball.

Another object of the present invention is to provide a method for producing a golf club head having an improved dischargeability of foreign matters from the face lines without lowering the frictional force between the face and a golf ball.

These and other objects of the present invention will become apparent from the description hereinafter.

SUMMARY OF THE INVENTION

In accordance with the present invention, there is provided a golf club head having a face for hitting a golf ball, said face including a hitting surface and at least one face line groove formed in said hitting surface, wherein said hitting surface includes a rough surface portion having an arithmetic mean surface roughness Raf of 0.20 to 0.55 μm, and the surface of said face line groove has an arithmetic mean surface roughness Ra1 smaller than the arithmetic mean surface roughness Raf of said rough surface portion.

Usually, the face line groove or grooves are formed in the rough surface portion, but may be formed to extend over the rough surface portion.

Preferably, the surface of the face line groove has an arithmetic mean surface roughness Ra1 of 0.05 to 0.20 μm.

Preferably, the arithmetic mean surface roughness Ra1 of the face line groove is from 0.10 to 0.80 times the arithmetic mean surface roughness Raf of the rough surface portion in the hitting surface.

The ball-hitting face as mentioned above is particularly suitable for iron-type golf club heads having a loft angle of 30 to 70 degrees.

The present invention also provides a method for producing a golf club head having a face for hitting a golf ball, comprising the steps of forming a rough surface portion having an arithmetic mean surface roughness Raf of 0.20 to 0.55 μm on said face, and forming at least one face line groove in said rough surface portion by pressing a marking stamp having a convex portion protruding from a main surface of the marking stamp against said rough surface portion so as to thrust only said convex portion into the face without bringing said main surface into contact with the face, thereby forming said face line groove without changing the surface roughness of said rough surface portion excepting said face line groove.

Preferably, the convex portion of the marking stamp has an arithmetic mean surface roughness Rat of 0.03 to 0.20 μm.

The face of the golf club head according to the present invention includes a hitting surface and at least one face line groove formed in the hitting surface, and the hitting surface includes a rough surface portion having an arithmetic mean surface roughness Raf of 0.20 to 0.55 μm. Since the face is provided with face line or lines and a rough surface portion having a large surface roughness, the frictional force with a ball in hitting the ball can be enhanced to impart a sufficient back spin to the ball. Further, since the face line or lines are formed to have an arithmetic mean surface roughness smaller than the arithmetic mean surface roughness Raf of the rough surface portion and, therefore, since the face line or lines have a groove surface with a small friction coefficient, foreign matters caught in the face line or lines can be relatively promptly discharged through, for example, vibration or the like of a golf club occurring at the time of swing. Thus, the golf club head of the present invention can effectively prevent the face lines from clogging with foreign matters such as water or mud, so it can prevent the amount of back spin from lowering and can provide a stable flight distance.

The term "arithmetic mean roughness" or "arithmetic mean surface roughness" as used herein means "arithmetic mean roughness in which the profile is roughness profile" defined in item 4.2.1 of "Geometrical Product Specifications (GPS)—Surface texture: Profile method—Terms, definitions and surface texture parameters".

The method of measuring the arithmetic mean surface roughness Ra is based on "7. Rules and procedures for the assessment by stylus instrument" in JIS B0633:2001 "Geometrical Product Specifications (GPS)—Surface texture: Profile method—Rules and procedures for the assessment of surface texture".

DETAILED DESCRIPTION OF THE INVENTION

An embodiment of the present invention will now be explained with reference to the accompanying drawings.

Figure 1:
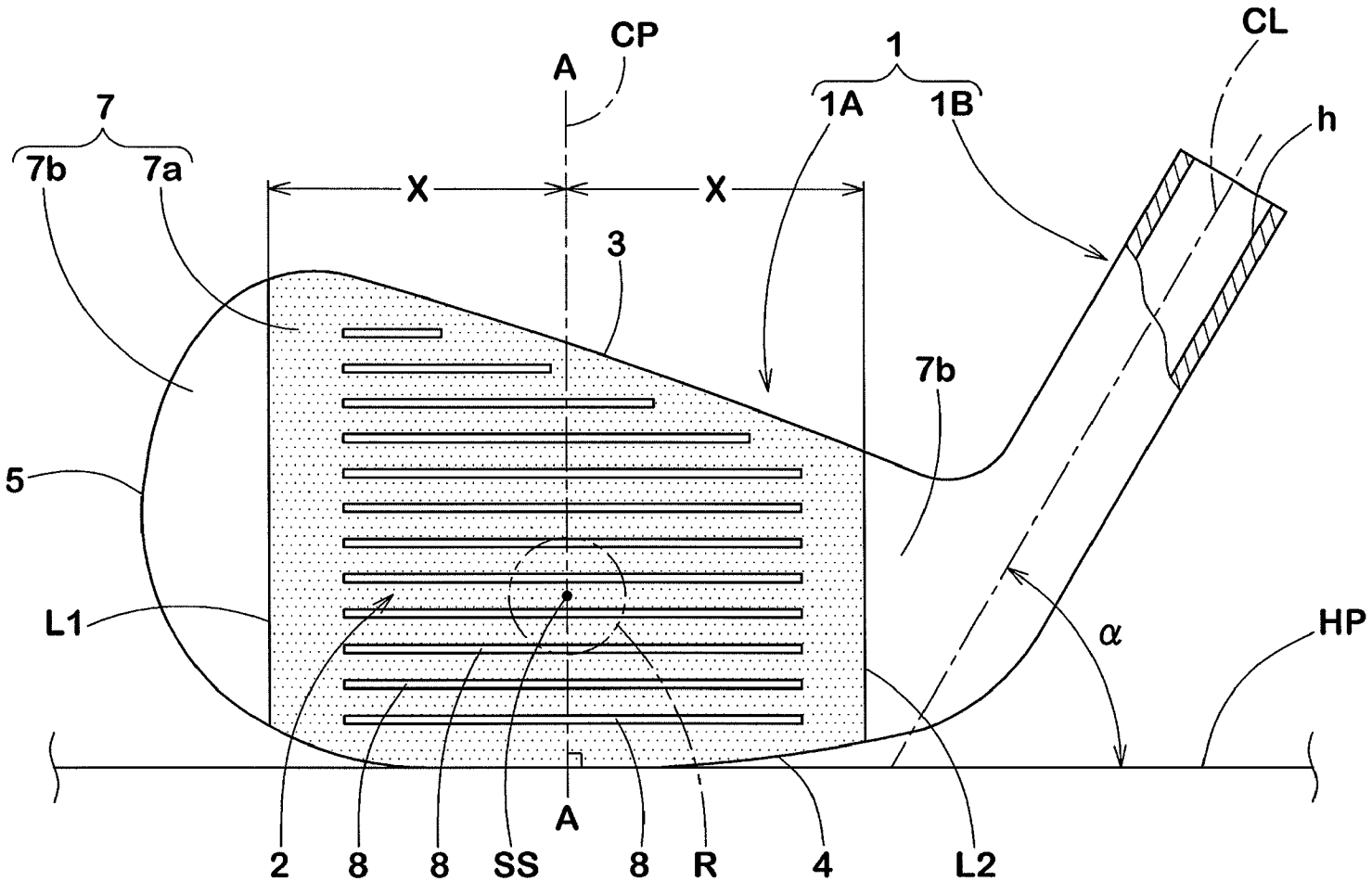
FIG. 1 is a front view of a golf club head showing an embodiment of the present invention.
Figure 2:
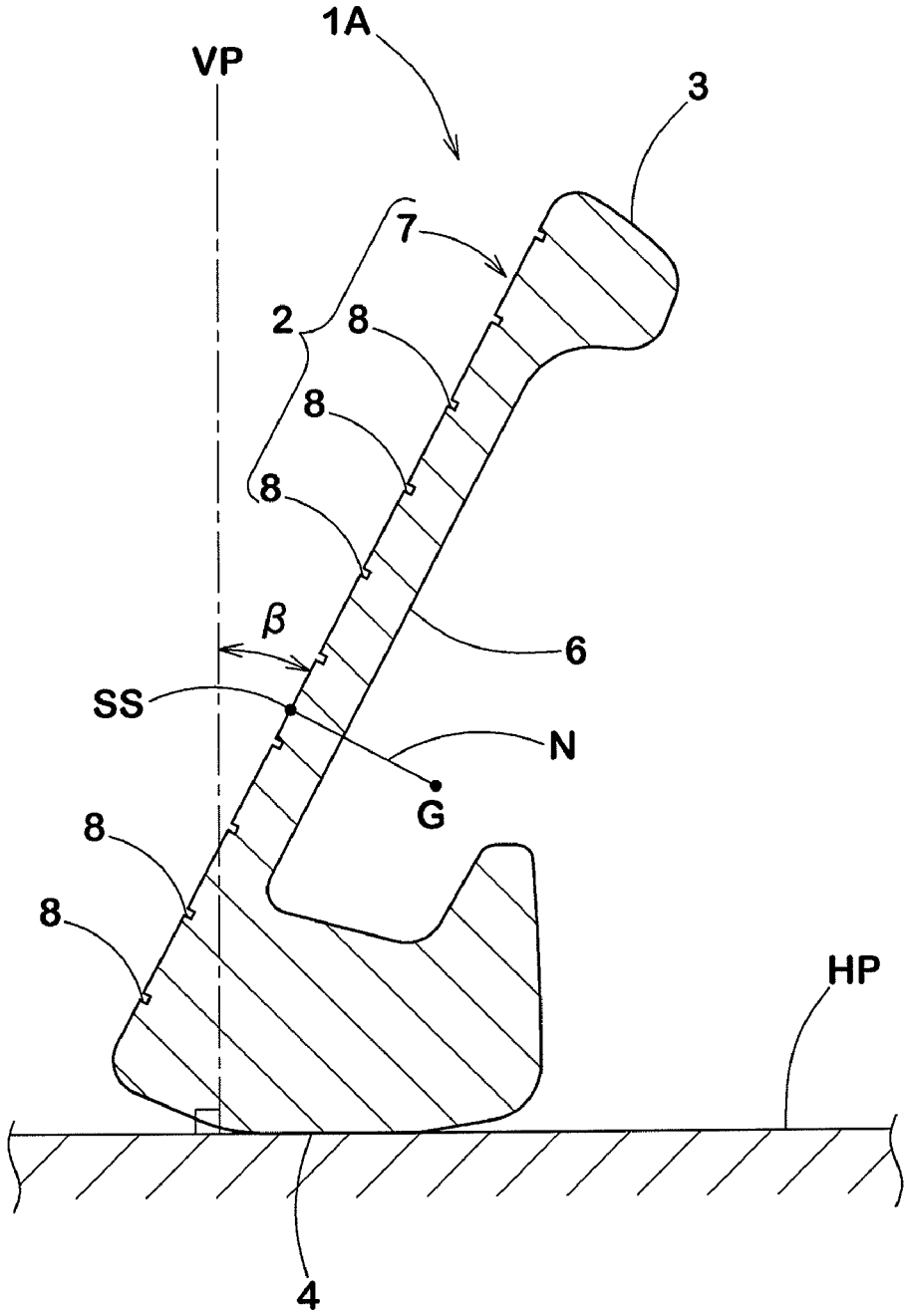
FIG. 2 is a cross sectional view along the line A-A of FIG. 1.
Figure 3:
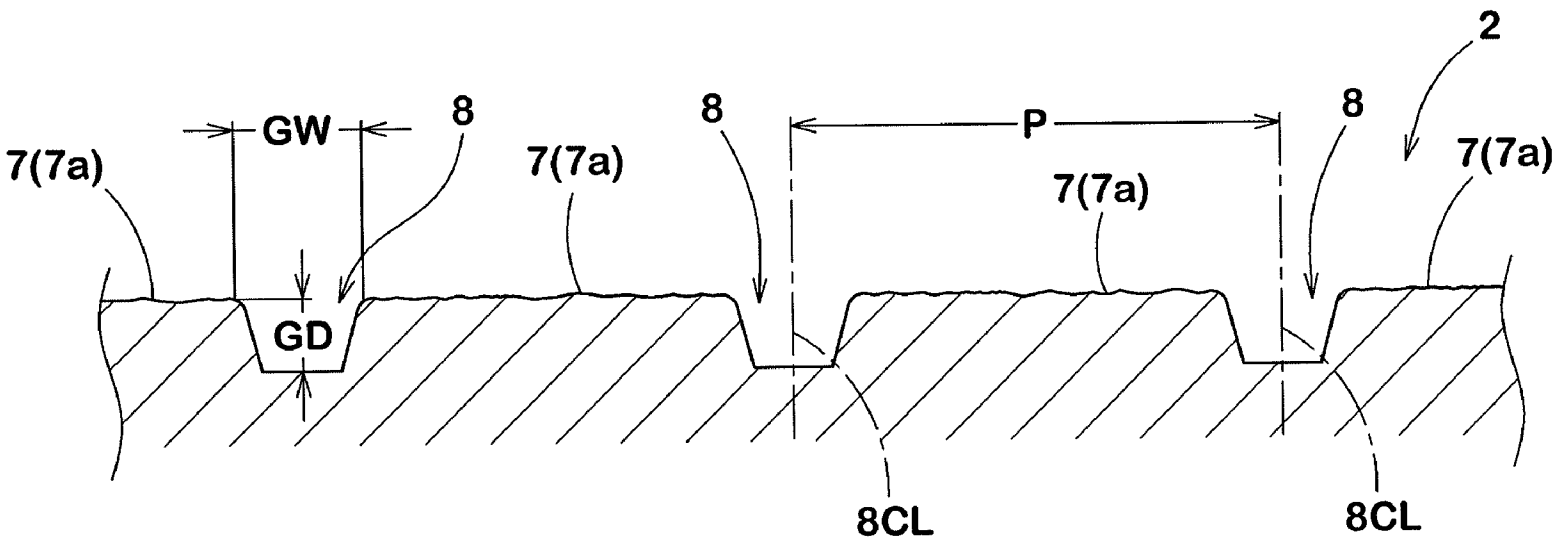
FIG. 3 is an enlarged view of a main portion in FIG. 2.

FIG. 1 is a front view of a golf club head 1 in the standard state according to an embodiment of the present invention, and FIGS. 2 and 3 are cross sectional views of the head 1.

The term "standard state" as used herein denotes the state that the club head 1 is placed on a horizontal plane HP in the state that the axial center line CL of a shaft is disposed in an arbitrary vertical plane VP (shown in FIG. 2) and is inclined at a prescribed lie angle α and, on the other hand, a club face 2 is inclined at a prescribed loft angle β with respect to the vertical plane VP.

The following explanation is made with respect to the club head 1 in the standard state unless otherwise noted. For example, with respect to the club head 1, the up-and-down direction and the terms "high" and "low" denotes those of the club head 1 in the standard state. Further, the front-and-rear direction or the terms "front" and "rear (or back)" denote that face 2 side is the front and back face 6 side is the rear. The toe-heel direction denotes a horizontal direction parallel to the vertical plane VP specified above.

In FIGS. 1 to 3 is shown an iron-type golf club head 1. The club head 1 in this embodiment comprises a head body portion 1A which has a face 2 for hitting a golf ball on the front side, and a hose 1 portion 1B which is formed integrally with the head body portion 1A on the heel side of the head body portion 1A and which has a shaft inserting hole "h" for inserting a shaft (not shown). In the case that a shaft is not attached to the club head 1, the center line of the shaft inserting hole "h" in the hose 1 portion 1B is used in place of the center line CL of the shaft.

In this embodiment, the whole club head 1 is made of a metallic material. Known metallic materials used in this field can be used in the present invention. Preferable examples of the metallic material are, for instance, a carbon steel, a stainless steel, a titanium alloy, and a marageing steel. The club head 1 may be made of a single kind of a metallic material or a composite material composed of at least two kinds of metallic materials. The club head 1 can be produced, for example, by casting or forging.

The head body portion 1A comprises the face 2, a top 3 which intersects with the face 2 at its upper edge and forms a head upper surface inclining downward from the toe side toward the heel side, a sole 4 which intersects with the face 2 at its lower edge and extends nearly horizontally in the toe-heel direction to form the bottom surface of the head 1, a toe 5 connecting the top 3 and the sole 4 on the toe side with a smoothly curved line to form a toe portion of the head 1, and a back face 6 which is a face on the side opposite to the face 2.

As shown in FIG. 2, the face 2 is composed of a hitting surface 7 and at least one face line 8 (in this embodiment, a plurality of face lines 8) formed in the hitting surface 7. The hitting surface 7 forms substantially a single plane when macroscopically viewed, and denotes a portion that the face lines 8 are excluded from the surface of the face 2.

The face lines 8 in the present invention must meet the specifications for grooves defined in item (i) of "5c. Impact Area Markings" in Golf Rules, Appendix II (Design of Clubs). In addition, the depth of grooves used herein is limited to 0.15 mm or more. Accordingly, the face line grooves 8 used in the present invention have the following dimensions.

- The width of the grooves GW does not exceed 0.9 mm (0.035 inches), using the 30 degree method of measurement on file with the R & A.
- The depth of a groove GD is from 0.15 to 0.508 mm.
- The grooves have a symmetrical cross section and have sides which do not converge.
- The grooves are straight and parallel.
- The width, spacing and cross-section of the grooves are consistent throughout the impact area.
- Any rounding of groove edges is in the form of a radius which does not exceed 0.508 mm (0.020 inches).
- The distance between edges of adjacent grooves is not less than 3 times the width of a groove, and is not less than 1.905 mm (0.075 inches).

As shown in FIGS. 1 and 2, the face line grooves 8 are disposed at intervals in the up-and-down direction and extend in the toe-heel direction. Here, the phrase "extend in the toe-heel direction" denotes such an extent that the face line grooves are recognized to lie approximately along the toe-heel direction when they are visually observed in the standard state. This is a matter of course from the fact that the club head 1 does not exactly return to the standard state after hitting a ball. Thus, it is acceptable that a face line groove 8 inclines at an angle of about ±4° with respect to the toe-heel direction.

In the golf club head 1 of the present invention, the hitting surface 7 of the face 2 is formed to include a rough surface portion 7*a* having an arithmetic mean roughness Raf of 0.20 to 0.55 μm in at least a part of the hitting surface 7. In this embodiment shown in FIGS. 1 to 3, the hitting surface 7 includes the rough surface portion 7*a* and non-rough surface portions 7*b* located in toe and heel portions on both sides of the rough surface portion 7*a*. Usually, the rough surface portion 7*a* provides an impact area. The face line grooves 8 of the face 2 are formed so that the surface of the grooves has an arithmetic mean roughness Ra1 smaller than the arithmetic mean surface roughness Raf of the rough surface portion 7*a*.

The face line grooves 8 and the rough surface portion 7*a* having such a large surface roughness serve to enhance the frictional force with a ball to impart a sufficient back spin to the ball. On the other hand, since the grooves 8 of the club head 1 of the present invention are formed to have a small surface roughness, foreign matters such as moisture, soil and grass which may caught in the grooves during playing are easy to be promptly discharged by vibration of the head or the like. Therefore, the club head 1 of the present invention can effectively prevent clogging of the grooves 8 as compared with known golf club heads. Thus, according to the club head 1 of the present invention, the amount of back spin can be prevented from decreasing during playing to provide a stable flight distance.

When the club head 1 of the present invention is applied to iron-type golf clubs which put importance on stability in flight distance, especially short irons which impart larger back spin to a ball, more stable flight distance is obtained. Therefore, the club head 1 of the present invention is particularly suitable for iron-type golf clubs, especially short iron clubs having a loft of at least 30 degrees, preferably at least 35 degrees, more preferably at least 40 degrees. However, since a ball may slip on the face if the loft angle is extremely large, it is preferable that the loft angle of these short irons is at most 70 degrees, especially at most 65 degrees, more especially at most 60 degrees.

If the arithmetic mean roughness Raf of the rough surface portion 7*a* is less than 0.20 μm, the surface thereof is too smooth to increase the amount of back spin. Therefore, the arithmetic mean roughness Raf of the rough surface portion 7*a* is preferably at least 0.25 μm, more preferably at least 0.30 μm. On the other hand, if the arithmetic mean roughness Raf of the rough surface portion 7*a* is more than 0.55 μm, a sufficient back spin is obtained, but the frictional force becomes excessively large and a ball is easy to suffer a scratch. Therefore, the arithmetic mean roughness Raf of the rough surface portion 7*a* is preferably at most 0.50 μm, more preferably at most 0.45 μm.

The rough surface portion 7*a* is formed in at least a part of the face 2. In the embodiment shown in FIGS. 1 to 3, the rough surface portion 7*a* is provided in a central area of face 2 including a sweet spot SS which is a point where a normal line N drawn to the face 2 from the center of gravity G of the club head 1 intersects the face 2 and which is the most suitable hitting point, whereby contact chance of the rough surface portion 7*a* with a ball is increased to surely impart a sufficient back spin to the ball.

Preferably, the rough surface portion 7*a* is formed in areas X, X extending from a vertical plane CP which is perpendicular to the face 2 and passes through the sweet spot SS, toward the toe and heel sides by a distance of at least 3 mm, especially at least 5 mm, more especially at least 8 mm, still more especially at least 10 mm, respectively. However, the location of the rough surface portion 7*a* is not limited to such an area.

The hitting surface 7 of the club head 1 in this embodiment includes the rough surface portion 7*a* and non-rough surface portions 7*b* disposed on both the toe and heel sides of the rough surface portion 7*a*.

The non-rough surface portion 7*b* has a surface worked to have an arithmetic mean roughness Raf of less than 0.20 μm, e.g., a mirror finished surface. The rough surface portion 7*a* and the non-rough surface portions 7*b* can be visually distinguished by vertical lines extending in the up-and-down direction and appearing by a difference in surface roughness between them, i.e., vertical line L1 on the toe side and vertical line L2 on the heel side.

The non-rough surface portions 7*b* serve to make a golfer recognize that an area between the vertical lines L1 and L2, i.e., rough surface portion 7*a*, is an impact area as well as imparting a better design to the club head 1. In this embodiment, face line grooves 8 are disposed within the rough surface portion 7*a*, but may extend over the vertical line L1 and/or the vertical line L2.

The entire hitting surface 7, in other words, the entire surface of face 2 excepting face line grooves 8, may be formed into the rough surface portion 7*a*. In this case, a ball can be brought into contact with the rough surface portion 7*a* even in the case of mis-shot.

In this embodiment shown in FIGS. 1 to 3, the arithmetic mean roughness Raf of the rough surface portion 7*a* is measured in an area within a circle R with a radius of 5 mm centered on the sweet spot SS.

Figure 4A:
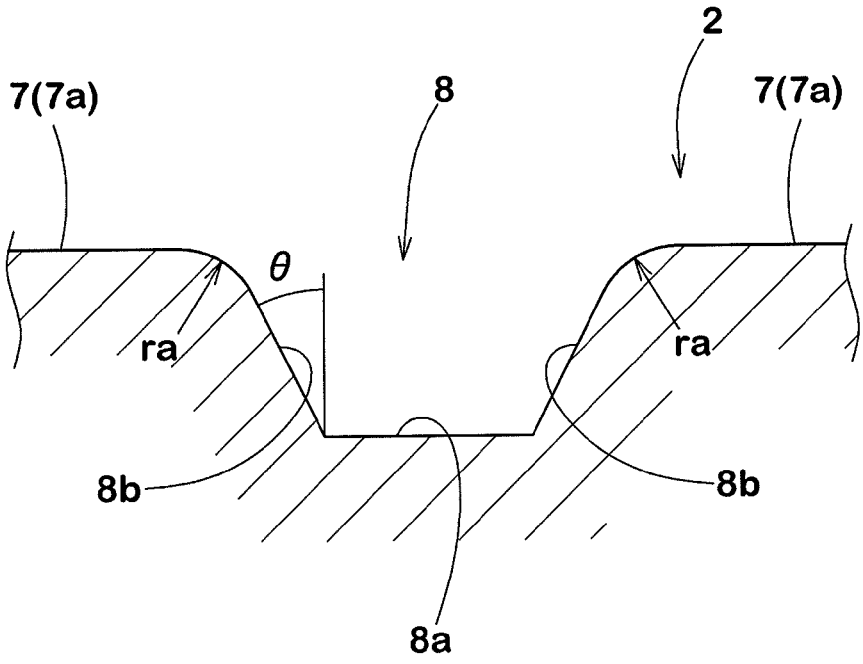
FIGS. 4A and 4B are cross sectional views showing examples of face lines used in the present invention.
Figure 4B:
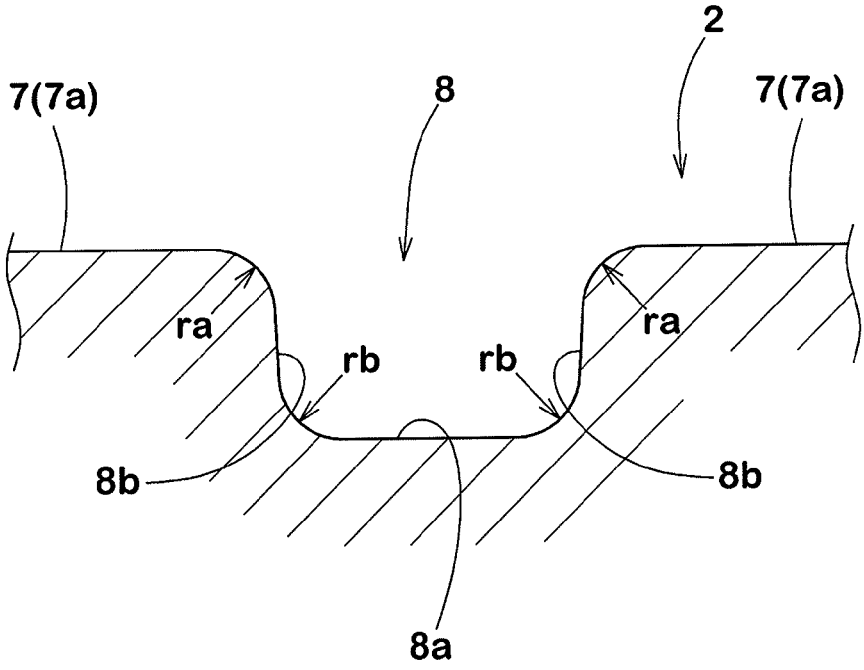

Examples of the face line groove 8 are shown in FIGS. 4A and 4B in an enlarged form. The phrase "surface of face line groove" as used herein means each of surfaces of groove bottom 8*a* and a pair of groove walls 8*b* extending from both edges of the bottom. Therefore, the arithmetic mean roughness Ra1 of the surface of the face line groove 8 is obtained by measuring the arithmetic mean roughness of the groove bottom 8*a* and the arithmetic mean roughness of each of a pair of the groove walls 8*b*, respectively, along the longitudinal direction of the groove and obtaining a mean value of them.

The arithmetic mean roughness Ra1 of the surface of the face line groove 8 is not particularly limited so long as it is lower than the arithmetic mean roughness Raf of the rough surface portion 7*a*. However, when the value Ra1 is too small, the production cost may increase from the viewpoint of processing. Therefore, it is preferable that the arithmetic mean roughness Ra1 of the surface of the face line groove 8 is at least 0.05 μm, especially at least 0.08 μm, more especially at least 0.10 μm. On the other hand, if the arithmetic mean roughness Ra1 of the surface of the face line groove 8 is large, the frictional force which acts to retain foreign matters in the groove increases. Therefore, it is preferable that the arithmetic mean roughness Ra1 is at most 0.20 μm, especially at most 0.15 μm, more especially at most 0.13 μm.

In particular, it is preferable to select the arithmetic mean roughness Ra1 of the surface of the face line groove 8 so that the ratio Ra1/Raf of the arithmetic mean surface roughness Ra1 of the groove 8 to the arithmetic mean surface roughness Raf of the rough surface portion 7*a* is at most 0.80, especially at most 0.50, more especially at most 0.40. The dischargeability of foreign matters from the grooves 8 is enhanced by selecting a small Ra1/Raf ratio. On the other hand, it is preferable that the Ra1/Raf ratio is at least 0.10, especially at least 0.20, more especially at least 0.25. It the Ra1/Raf ratio is less than 0.10, the processing cost for the face line grooves 8 tends to increase and the productivity tends to deteriorate.

The face line grooves 8 in the present invention have dimensions as defined above.

On the other hand, if the groove depth GD is relatively small, there is a tendency that a sufficient back spin is not obtained. Therefore, it is preferable that the depth GD of the face line groove 8 is at least 0.20 mm, especially at least 0.25 mm, more especially at least 0.30 mm. If the groove depth GD is relatively large, there is a tendency that the cost for forming the grooves increases. Therefore, it is preferable that the depth GD of the face line groove 8 is at most 0.50 mm, especially at most 0.45 mm, more especially at most 0.40 mm.

If the width GW of the face line groove 8 is too small, foreign matters, particularly water, is hard to enter into the groove, thus decreasing the drainage effect, so there is a possibility that no sufficient back spin is obtained. Therefore, it is preferable that the width GW of the face line groove 8 is at least 0.30 mm, especially at least 0.40 mm, more especially at least 0.50 mm. On the other hand, the groove width GW is at most 0.90 mm, preferably at most 0.80 mm, more preferably at most 0.70 mm.

If the spacing P between adjacent face line grooves 8, 8 (i.e., distance between center lines 8CL for the width GW of the adjacent grooves 8, as shown in FIG. 3) is too small, the area of the hitting surface 7 is decreased. Therefore, it is preferable that the spacing P between the adjacent grooves 8 is at least 1.8 mm, especially at least 1.9 mm, more especially at least 2.0 mm, still more especially at least 2.3 mm, further especially at least 2.4 mm, still further especially at least 2.5 mm. On the other hand, if the spacing P is too large, the number of grooves is decreased, so the grooves cannot exhibit a sufficient drainage effect and no sufficient back spin is obtained when playing in rain. Therefore, it is preferable that the spacing P is at most 4.3 mm, especially at most 4.1 mm, more especially at most 4.0 mm, still more especially at most 3.5 mm, further especially at most 3.3 mm, still further especially at most 3.2 mm.

If the cross section area of the face line groove 8 is too small, the drainage effect of the face 2 tends to decrease, and if it is too large, the groove 8 tends to be easily clogged with foreign matters. Therefore, it is preferable that the cross sectional area of the groove 8 is at least 0.08 $mm^2$, especially at least 0.09 $mm^2$, more especially at least 0.10 $mm^2$, and it is at most 0.45 $mm^2$, especially at most 0.40 $mm^2$, more especially at most 0.38 $mm^2$.

The face line groove 8 has diverging sides (sidewalls 8*b*). The inclination angle θ of the sidewall 8*b* with respect to a vertical line to the groove bottom 8*a* (see FIG. 4A) is preferably at least 1°, more preferably at least 3°, the most preferably at least 5°. If the inclination angle θ is increased, the volume of the groove 8 is decreased since the upper limits of the width and depth are restricted. Therefore, the inclination angle θ of the sidewall 8*b* is preferably at most 30°, more preferably at most 28°, the most preferably at most 25°.

Face line grooves having a trapezoidal cross section and an inclination angle θ of 30° or 1° are shown in FIGS. 4A and 4B, respectively. These face line grooves have a trapezoidal cross section, but may have other various cross section shapes, e.g., V-shape or arc shape, so long as the cross section is symmetrical.

The face line grooves 8 have round edges. As shown in FIGS. 4A and 4B, the radius of curvature "ra" of a roundness (circular arc chamfer in section) of the face line groove 8 is preferably at least 0.12 mm, more preferably at least 0.13 mm, still more preferably at least 0.14 mm. If the radius of curvature "ra" is small, a golf ball tends to scar easily. On the other hand, if the radius of curvature "ra" is large, the frictional force with the ball tends to decrease. Therefore, the radius of curvature "ra" is preferably at most 0.40 mm, more preferably at most 0.38 mm, still more preferably at most 0.36 mm.

The bottom edges of groove 8 (i.e., corners between the groove bottom 8*a* and the sidewalls 8*b*) may be sharp as shown in FIG. 4A, or may be round (may be chamfered in a smooth arc form) as shown in FIG. 4B. In the latter case, the radius of curvature "rb" of the arc is preferably at least 0.12 mm, more preferably at least 0.13 mm, still more preferably at least 0.14 mm. If the radius of curvature "rb" is small, foreign matters are easy to remain in the corners. On the other hand, if the radius of curvature "rb" is large, the volume of the face line groove 8 may be decreased to deteriorate the drainage effect. Therefore, the radius of curvature "rb" is preferably at most 0.40 mm, more preferably at most 0.38 mm, still more preferably at most 0.36 mm.

The face 2 may be provided with auxiliary grooves or decorative markings.

Figure 5:
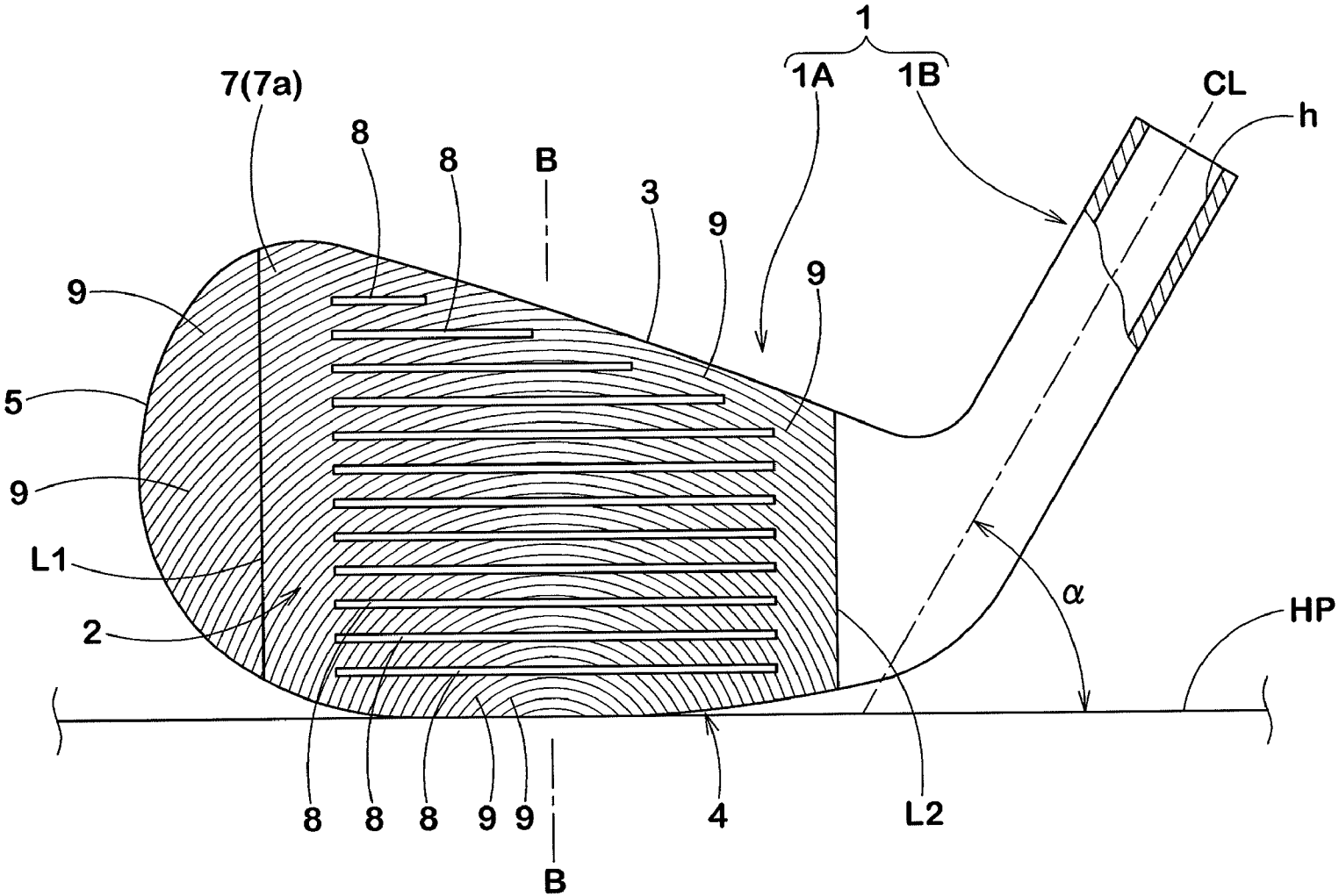
FIG. 5 is a front view of a golf club head showing another embodiment of the present invention.
Figure 6:
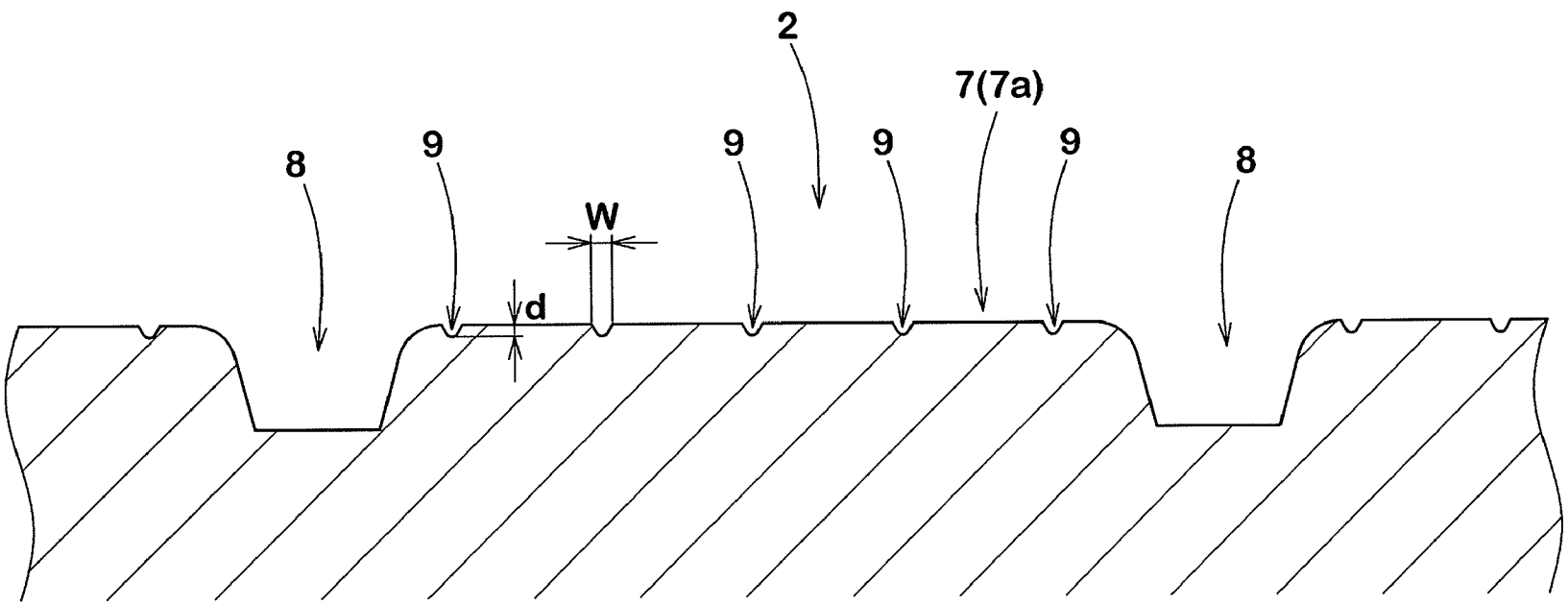
FIG. 6 is a partially enlarged cross sectional view of a face at the line B-B of FIG. 5.

Another embodiment of the present invention is shown in FIG. 5 and FIG. 6 which is a partially enlarged cross sectional view of a face 2 at the line B-B of FIG. 5. In this embodiment, the face 2 includes a hitting surface 7 and at least one face line groove 8 formed in the hitting surface 7. The hitting surface 7 is further provided with a plurality of auxiliary grooves 9 having a smaller width "W" and a smaller depth "d" than those of the face line grooves 8. The auxiliary grooves 9 serve to enhance the surface roughness of the hitting surface 7, and provide a surface having a surface roughness such that it does not exceed a surface roughness of decorative sandblasting or of fine milling In FIG. 5, the auxiliary grooves 9 are exaggeratedly shown in order to help understanding.

The auxiliary grooves 9 in this embodiment are provided in substantially the entire area of the face 2 excepting portions of the face line grooves. The auxiliary grooves 9 are disposed, for example, at regular intervals without intersecting with each other. Such auxiliary grooves 9 serve to prevent a strain of a ball surface (a cover of a golf ball) generating at the time of impact from concentrating at a portion of the ball corresponding to a vicinity of a face line groove 8 to thereby disperse the strain. Thus, the ball is suppressed from suffering a scratch, while enhancing the frictional force with the ball to more stably impart a back spin to the ball.

It is preferable that the auxiliary grooves 9 have a depth "d" of 0.005 to 0.025 mm. If the depth "d" is less than 0.005 mm, the strain generating in the cover of a ball at the time of impact is hard to be dispersed. The depth "d" of the auxiliary grooves 9 is more preferably at least 0.010 mm, still more preferably at least 0.015 mm. The depth "d" exceeding 0.025 mm will violate a golf rule.

The width "W" of the auxiliary grooves 9 is preferably at least 0.1 mm, more preferably at least 0.2 mm, and as to the upper limit thereof, it is preferably at most 1.0 mm, more preferably at most 0.8 mm. If the width "W" is too small, the effect of dispersing the strain of the ball cover tends to lower, and if it is too large, the ball tends to suffer a scratch. The edges of the auxiliary groove 9 may be chamfered into a circular arc shape in cross section of the groove. In that case, the width "W" of the auxiliary groove 9 denote a distance between the outer ends of the arcs.

In the embodiment shown in FIGS. 5 and 6, the auxiliary grooves 9 are formed to have an approximately circular arc cross section. However, the auxiliary grooves 9 may have various cross sectional shapes, e.g., approximately trapezoidal shape with diverging sides, V-shape, circular arc and combinations thereof, like the face line grooves 8. The auxiliary grooves 9 shown in this embodiment extend in the form of arcs disposed concentrically, but the grooves may be wavy grooves or straight grooves.

The club heads 1 of the present invention are prepared, for example, by the following method.

Figure 7A:
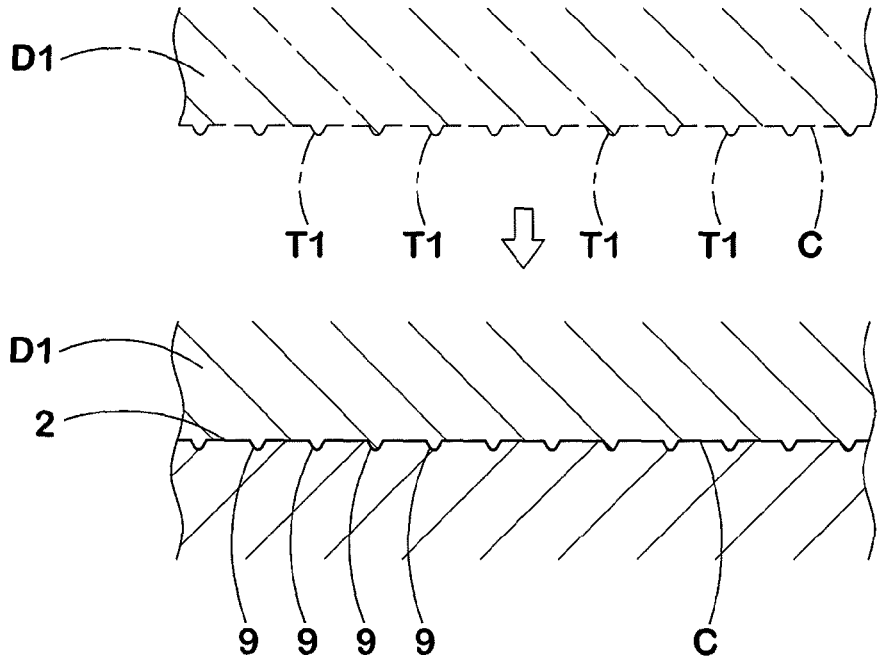
FIGS. 7A, 7B, 8A and 8B are cross sectional views illustrating an embodiment of the method for producing golf club heads according to the present invention.

Firstly, a rough surface portion 7*a* is formed in a face 2 of a golf club head 1 formed by forging or casting. In the method illustrated in FIGS. 7A, 7B, 8A and 8B, prior to carrying out the step of forming the rough surface portion 7*a*, auxiliary grooves 9 are formed by pressing a marking stamp or die D1 to the face 2 temporarily finished by milling or the like, as shown in FIG. 7A. The marking stamp D1 has a molding surface including a main surface C constituting a single plane and convex portions T1 which protrude from the main surface C and which have an inverted shape for the above-mentioned auxiliary grooves 9, in other words, a contour corresponding to that of auxiliary groove 9 to be formed. Formation of the auxiliary grooves 9 in the surface of the face 2 is achieved by pressing the marking stamp D1 having such a molding surface against the face 2.

Figure 7B:
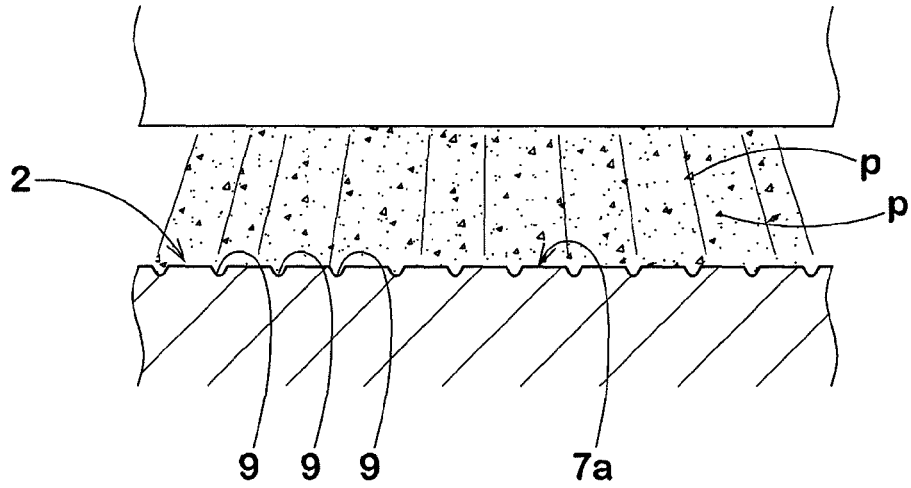

A rough surface portion 7*a* having an arithmetic mean roughness Raf of 0.20 to 0.55 μm is then formed on an arbitrary portion, preferably an impact area, of the face 2 by, for example, a shot blasting treatment wherein a shot blasting abrasive "p" is thrown onto the surface of the face 2, as shown in FIG. 7B. The rough surface portion 7*a* can of course be formed by other known methods such as sandblasting, press work and cutting work. The arithmetic mean roughness Raf can be adjusted by changing the particle size of the abrasive "p", the throwing time and/or the throwing speed. If the shot blasting treatment is conducted prior to the formation of auxiliary grooves 9, the rough surface portion 7*a* is smoothened since the main surface C of the marking stamp D1 is pressed thereto. Therefore, in case of forming auxiliary grooves 9, it should be conducted prior to the formation of rough surface portion 7*a*.

Figure 8A:
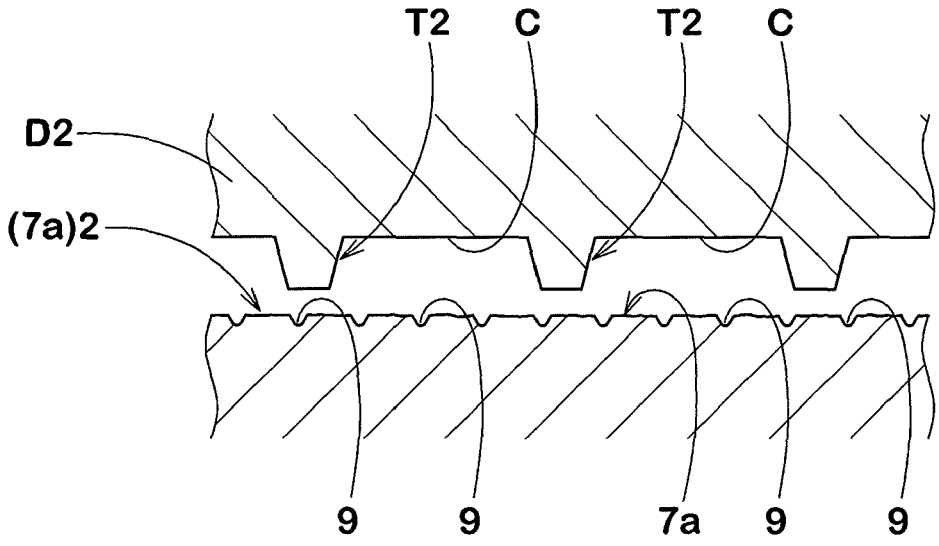
Figure 8B:
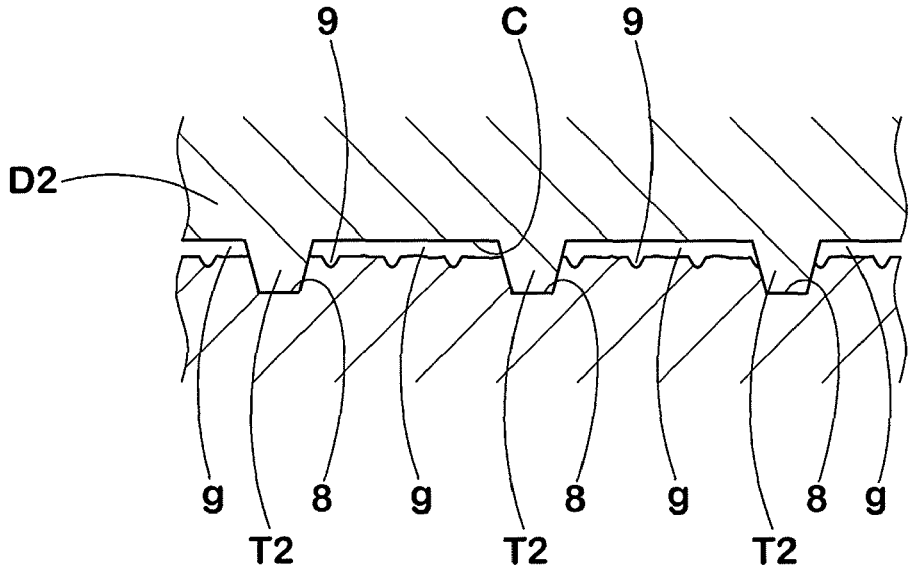

At least one face line groove 9, preferably a plurality of face line grooves 9, are then formed in the rough surface portion 7*a* by pressing a marking stamp or die D2 to the rough surface portion 7*a*, as shown in FIG. 8A. The marking stamp D2 has a molding surface including a main surface C and convex portions T2 each protruding from the main surface C. The convex portions T2 of the stamp D2 are perpendicularly thrust into the face 2 to form the face line grooves 9 in such a manner that the stamp D2 is pressed against the face 2 so as to bring only the convex portions T2 into contact with the face 2, as shown in FIG. 8B. By stamping in such a manner, the main surface C of the stamp T2 does not come into contact with the face 2 to retain a space "g" between the main surface C and the face 2, whereby the face line grooves 8 can be formed without changing the surface roughness of the rough surface portion 7*a* excepting the face line grooves 8. Further, since the stamping for the face line grooves 8 is conducted after forming the rough surface portion 7*a*, good-looking face line grooves 8 can be formed without cutting, crushing or deforming the edges and bottom corners of the grooves 8.

It is preferable that the convex portions T2 of the marking stamp D2 have an arithmetic mean surface roughness Rat of at least 0.03 μm, especially at least 0.05 μm, and is at most 0.2 μm, especially at most 0.15 μm. By perpendicularly thrusting the protruding portions T2 having such a surface roughness into the face 2, the arithmetic mean surface roughness Ra1 of the face line grooves 8 can be made smaller than the arithmetic mean surface roughness Raf of the rough surface portion 7*a*, simultaneously with achievement of the stamping.

After forming the face line grooves 8, the surface thereof may be polished to adjust the arithmetic mean roughness Ra1, as occasion demands.

The formation of the face line grooves 8 can be made by known methods other than the above-mentioned method using a marking stamp, e.g., cutting work such as NC machining.

While preferable embodiments of the present invention have been described with reference to the drawings, it goes without saying that the present invention is not limited to only such embodiments and various changes and modifications may be made.

The present invention is more specifically described and explained by means of the following Examples and Comparative Examples. It is to be understood that the present invention is not limited to these Examples.

EXAMPLES 1 TO 3 AND COMPARATIVE EXAMPLES 1 AND 2

Iron-type golf club heads having a loft angle of 46° (pitching wedge) were produced based on the specifications shown in FIG. 5 and Table 1 by forging a soft iron (S25C) to give a club head, then forming auxiliary grooves in the surface of the face by a press work, subsequently subjecting the face to a shot blasting treatment to form a rough surface portion, and then forming face line grooves by using a marking stamp. The specifications of the face line grooves and the auxiliary grooves are as described below and are common to all Examples. The shot blasting and the stamping for the face lines were carried out under the following conditions. The performances of the thus obtained club heads were measured by the following methods.

<Specification of Face Line Grooves>

Groove depth GD: 0.35 mm

Groove width GW: 0.70 mm

Spacing between adjacent grooves (distance between center lines of respective adjacent grooves): 3.5 mm Cross sectional shape: trapezoid Area of cross section: 0.18 $mm^2$ Inclination angle of sidewalls: 20 degrees Radius of curvature "ra" of arc-like edges of groove: 0.14 mm <Specification of Auxiliary Grooves>

Groove depth "d": 0.02 mm

Groove width W: 0.3 mm

Spacing between adjacent grooves (distance between center lines of respective adjacent grooves): 0.5 mm Cross sectional shape: approximately semicircle Planar shape: circular arc shown in FIG. 5

<Shot Blasting>

Shot blasting media: spherical steel shot having an average particle size of 0.3 mm Air pressure for shot blasting: 0.3 MPa Throwing time: 10 to 20 seconds (The surface roughness was adjusted by changing the throwing time within this range.)

<Stamping Step>

Arithmetic mean surface roughness of convex portions of marking stamp: 0.05 μm

<Amount of Back Spin of Hit Ball>

A steel shaft was attached to each of the club heads to give an iron-type golf club. Each of ten golfers having a handicap of 0 to 9 hit 30 three piece golf balls placed directly on a fairway of grass length about 15 mm with each golf club. The amount of back spin of hit ball was measured by a trajectory tracking apparatus (TrackMan™ made by ISG A/S). The test was made both on a fairway in dry condition and on the fairway in such a wet condition that after making the test in the dry state, the head was washed with water and a ball was hit by the wet head without wiping up water on the face. An average value of each of an initial 10 ball group, a next 10 ball group and a final 10 ball group was obtained. The smaller the decrease in the amount of back spin during hitting of 30 golf balls, the better.

<Clogging State of Face Line Grooves with Foreign Matters>

After the hitting test in the wet state, the face line grooves were visually observed and the total length of portions of the grooves clogged with mud was measured. The estimation was made according to the following criteria.

○: Total length of portions clogged with mud is less than 30 mm.

Δ: Total length of portions clogged with mud is not less than 30 mm to less than 100 mm.

x: Total length of portions clogged with mud is not less than 100 mm.

The test results are shown in Table 1.

TABLE 1

| | Example 1 | Example 2 | Example 3 | Com. Ex. 1 | Com. Ex. 2 |
|---|---|---|---|---|---|
| Arithmetic mean roughness Raf of rough surface portion (μm) | 0.4 | 0.25 | 0.4 | 0.1 | 0.4 |
| Arithmetic mean roughness Ral of face line grooves (μm) | 0.1 | 0.1 | 0.15 | 0.1 | 0.5 |
| Ratio Ral/Raf | 0.25 | 0.40 | 0.38 | 1.00 | 1.25 |
| Amount of back spin (r.p.m.) Dry state | | | | | |
| Initial 10 balls | 6,800 | 6,680 | 6,800 | 6,500 | 6,800 |
| Next 10 balls | 6,760 | 6,650 | 6,750 | 6,460 | 6,710 |
| Final 10 balls | 6,740 | 6,630 | 6,730 | 6,440 | 6,670 |
| Amount of decrease in back spin | 60 | 50 | 70 | 60 | 130 |

TABLE 1-continued

| | Example 1 | Example 2 | Example 3 | Com. Ex. 1 | Com. Ex. 2 |
|---|---|---|---|---|---|
| Wet state | | | | | |
| Initial 10 balls | 6,600 | 6,470 | 6,580 | 6,250 | 6,560 |
| Next 10 balls | 6,580 | 6,420 | 6,530 | 6,210 | 6,310 |
| Final 10 balls | 6,520 | 6,390 | 6,490 | 6,170 | 6,070 |
| Amount of decrease in back spin | 80 | 80 | 90 | 80 | 490 |
| Clogging state of face line grooves | | | | | |
| Dry state | ○ | ○ | ○ | ○ | Δ |
| Wet state | ○ | ○ | ○ | ○ | X |

It is observed in Table 1 that the club heads of the Examples according to the present invention have performances that decrease in the amount of back spin is small and clogging of the face line grooves with foreign matters occurs only slightly. On the other hand, it is observed that since the club head of Comparative Example 1 has no rough surface portion, a sufficient back spin is not imparted to the ball and accordingly the ball controllability required for pitching wedge is not good. It is further observed that the club head of Comparative Example 2 causes a marked clogging of the face line grooves and decrease in the amount of back spin is also large.

What is claimed is:

1. A method for producing a golf club head having a face for hitting a golf ball, comprising the steps of:

forming a rough surface portion having an arithmetic mean surface roughness Raf of 0.20 to 0.55μm on said face, and forming at least one face line groove in said rough surface portion by pressing a marking stamp having a molding surface including a main surface and at least one convex portion protruding from said main surface of said marking stamp against said rough surface portion so as to thrust only said convex portion into said face without bringing said main surface into contact with said face, thereby forming said face line groove without changing the surface roughness of said rough surface portion excepting said face line groove, wherein said molding surface includes a plurality of said convex portions protruding from said main surface.

2. The method of claim 1, wherein said convex portion of said marking stamp has an arithmetic mean surface roughness Rat of 0.03 to 0.20 μm.

3. The method of claim 1, which further comprising a step of forming auxiliary grooves having a smaller width and a smaller depth than those of said face line groove, wherein said auxiliary grooves have a depth of 0.005 to 0.025 mm and a width of 0.1 to 1.0 mm.

4. A method for producing a golf club head having a face for hitting a golf ball, comprising the steps of:

forming a plurality of auxiliary grooves having a depth of 0.005 to 0.025 mm and a width of 0.1 to 1.0 mm by pressing a marking stamp D1 to a temporarily finished face of the golf club, said marking stamp D1 having a molding surface including a main surface and a plurality of convex portions protruding from said main surface, subsequently forming a rough surface portion having an arithmetic mean surface roughness Raf of 0.20 to 0.55 μm on said face, and forming at least one face line groove in said rough surface portion by pressing a marking stamp D2 having a molding surface including a main surface and at least one convex portion protruding from said main surface of said marking stamp D2 against said rough surface portion so as to thrust only said convex portion into said face without bringing said main surface into contact with said face, thereby forming said face line groove without changing the surface roughness of said rough surface portion excepting said face line groove, wherein said auxiliary grooves have a smaller width and a smaller depth than those of said face line groove.

5. The method of claim 4, wherein said at least one convex portion of said marking stamp D2 has an arithmetic mean surface roughness Rat of 0.03 to 0.20 μm, and is thrust perpendicularly into said face to thereby form said at least one face line groove which has a smaller arithmetic mean surface roughness Ral than said arithmetic mean surface roughness Raf of said rough surface portion.

* * * * *